US009038583B2

(12) United States Patent
Stolk et al.

(10) Patent No.: US 9,038,583 B2
(45) Date of Patent: May 26, 2015

(54) INTERNAL COMBUSTION ENGINE VALVE DRIVE ARRANGEMENT

(71) Applicant: DAIMLER AG, Stuttgart (DE)

(72) Inventors: Thomas Stolk, Kirchheim (DE); Alexander Von Gaisberg-Helfenberg, Beilstein (DE); Stephan Zentner, Amstetten (DE)

(73) Assignee: DAIMLER AG, Stuttgart (DE)

( * ) Notice: Subject to any disclaimer, the term of this patent is extended or adjusted under 35 U.S.C. 154(b) by 0 days.

(21) Appl. No.: 13/968,910

(22) Filed: Aug. 16, 2013

(65) Prior Publication Data

US 2014/0020642 A1 Jan. 23, 2014

Related U.S. Application Data

(63) Continuation-in-part of application No. PCT/EP2011/006070, filed on Dec. 3, 2011.

(30) Foreign Application Priority Data

Feb. 17, 2011 (DE) ..... 10 2011 011 457

(51) Int. Cl.

| | |
|---|---|
| ***F01L 1/34*** | (2006.01) |
| ***F02D 13/00*** | (2006.01) |
| ***F01L 13/00*** | (2006.01) |
| *F01L 1/047* | (2006.01) |

(52) U.S. Cl.

CPC ..... *F02D 13/00* (2013.01); *F01L 13/0036* (2013.01); *F01L 2001/0473* (2013.01); *F01L 2013/0052* (2013.01)

(58) Field of Classification Search

CPC ..... F02D 13/00; F01L 13/0036; F01L 2001/0473; F01L 2013/0052

USPC ..... 123/90.15–90.18

See application file for complete search history.

(56) References Cited

U.S. PATENT DOCUMENTS

| | | | | |
|---|---|---|---|---|
| 8,191,524 | B2 * | 6/2012 | Elendt et al. | 123/90.6 |
| 8,307,795 | B2 * | 11/2012 | Meintschel et al. | 123/90.16 |
| 8,347,837 | B2 | 1/2013 | Meintschel | |
| 8,387,579 | B2 * | 3/2013 | Stolk et al. | 123/90.18 |
| 8,474,424 | B2 * | 7/2013 | Meintschel et al. | 123/90.18 |
| 8,567,361 | B2 * | 10/2013 | Gruberger | 123/90.18 |
| 8,584,639 | B2 | 11/2013 | Elendt | |
| 2005/0011480 | A1 * | 1/2005 | Schultz et al. | 123/90.16 |
| 2010/0199935 | A1 * | 8/2010 | Lengfeld et al. | 123/90.15 |
| 2011/0247577 | A1 * | 10/2011 | Elendt et al. | 123/90.18 |
| 2012/0138000 | A1 * | 6/2012 | Schadel et al. | 123/90.18 |
| 2012/0138001 | A1 * | 6/2012 | Werler et al. | 123/90.18 |
| 2013/0306014 | A1 * | 11/2013 | Stolk et al. | 123/90.18 |

FOREIGN PATENT DOCUMENTS

| | | |
|---|---|---|
| DE | 10 2004 021 375 | 1/2006 |
| DE | 10 2007 037 745 | 2/2009 |

(Continued)

*Primary Examiner* — Zelalem Eshete

(74) *Attorney, Agent, or Firm* — Klaus J. Bach

(57) ABSTRACT

In an internal combustion engine valve drive arrangement having cam elements which are supported on a camshaft so as to be axially displaceable and having switch gates which are coupled to the cam elements and have gate tracks with track segments and switching segments for displaceing the cam elements, the track segments and the switching segments are formed, at least in part, in partial areas of the switch gates.

7 Claims, 8 Drawing Sheets

(56) References Cited

FOREIGN PATENT DOCUMENTS

| | | |
|---|---|---|
| DE | 10 2007 037 746 | 2/2009 |
| DE | 10 2007 037 747 | 2/2009 |
| DE | 10 2007 054977 A1 | 5/2009 |
| DE | 10 2009 053 | 9/2010 |

* cited by examiner

INTERNAL COMBUSTION ENGINE VALVE DRIVE ARRANGEMENT

This is a Continuation-In-Part application of pending international patent application PCT/EP2011/006070 filed Dec. 3, 2011 and claiming the priority of German patent application 10 2011 011 457.2 filed Feb. 17, 2011.

BACKGROUND OF THE INVENTION

The invention relates to an internal combustion engine valve drive arrangement including cam elements supported on a cam shaft so as to be axially displaceable and switch gate mechanisms coupled to the cam elements for axially moving the cam elements.

An internal combustion engine valve drive arrangement having independently axially displaceable cam elements and having a switch gate for displacing the cam elements is already known from DE 10 2004 021 375 A1.

It is the object of the present invention to provide a valve lift switching arrangement for an internal combustion engine having at least three cylinders arranged in a row wherein the three cyliders have different valve activation times.

SUMMARY OF THE INVENTION

In an internal combustion engine valve drive arrangement having cam elements which are supported on a camshaft so as to be axially displaceable and having switch gates which are coupled to the cam element and have gate tracks with track segments and switching segments for displaceing the cam element, the track segments and the switching segments are formed, at least in part, in partial areas of the switch gates.

It is proposed that the track segment and the switching segment are designed in one piece in at least one partial area. An angular range which includes the track segment and the switching segment may thus advantageously be kept small, so that the gate track may advantageously have a large number of switching segments. In particular, a continuous gate track having at least three switching segments may thus be implemented, so that valve lift switching for an internal combustion engine having at least three cylinders arranged in a row, having different valve activation times, may be achieved. A "switch gate" is understood to mean a unit for axially displacing the at least one cam element, and which has at least one gate track that is provided for converting a rotary motion into an axial adjusting force. A "gate track" is understood in particular to mean a track for forced guidance on one or both sides of a switch pin. The gate track is preferably designed in the form of a web, in the form of a slot, and/or in the form of a groove. The switch pin is preferably designed in the form of a shifting shoe which surrounds the web, in the form of a pin which engages in the slot, and/or in the form of a pin which is guided in the groove.

A "track segment" is understood to mean a segment of the gate track which has at least one radial inclination. A "radial inclination" is understood in particular to mean that the gate track in this segment has an inclination by which a progression of the gate track radially deviates from a circular line about a main rotational axis of the at least one cam element, as the result of which a rotary motion of a camshaft may be converted into a radially acting force. The track segment is preferably designed as a meshing segment of the gate track or as a demeshing segment of the gate track. A "meshing segment" is understood in particular to mean a segment in which the radial inclination results in an effective height which increases in the rotational direction. A "demeshing segment" is understood in particular to mean a segment in which the radial inclination results in an effective height which decreases in the rotational direction. A "rotational direction" is understood in particular to mean a direction of rotation along which the cam element is acted on by a rotary motion during a valve activation.

A "switching segment" is understood in particular to mean a segment of the gate track which has at least one axial inclination. An "axial inclination" is understood in particular to mean that the gate track in this segment has an inclination by which a progression of the gate track axially deviates from a circular line about a main rotational axis of the at least three cam elements, as the result of which a rotary motion of the camshaft may be converted into an axially acting force. A "segment" is understood in particular to mean a portion of the gate track with which a defined function, for example switching the at least one cam element, meshing a switch pin, or demeshing a switch pin is associated. In principle, the gate track may have multiple segments of the same type situated one behind the other, for example multiple switching segments having different functions, for example switching of different cam elements. In this context, "in one piece" is understood in particular to mean that the gate track has a double functionality in the partial area, i.e., is simultaneously provided for meshing or demeshing a switch pin and for switching the at least one cam element.

It is further proposed that the at least one track segment includes a partial area which has only a radial inclination. The track segment may thus be partially separate from the switching segment, so that the switch pin may be meshed with the gate track in a particularly secure manner. In this context, "only" is understood in particular to mean that the track segment in the partial area has only one increasing or decreasing effective height. In particular, this term is understood to mean that the gate track in this partial area has no axial inclination.

In addition, it is proposed that the switching segment includes a partial area which has only an axial inclination. The switching segment may thus be provided with a length, necessary for switching the at least one cam element, which keeps forces acting on the switch pin sufficiently small. The switching segment preferably has a length of at least 60 degrees camshaft angle, advantageously at least 80 degrees camshaft angle, and particularly advantageously at least 100 degrees camshaft angle. An "angular range" is understood in particular to mean an extension of the cam element in the peripheral direction. A degree indication in "degrees camshaft angle" is understood in particular to mean the degree indication based on the camshaft; i.e., one revolution of the camshaft corresponds to 360 degrees camshaft angle.

In one particularly advantageous embodiment, it is proposed that the at least one gate track has an axial inclination and a radial inclination in the at least one partial area in which the track segment and the switching segment are designed in one piece. The partial area in which the track segment and the switching segment are designed in one piece may thus have a particularly advantageous design.

In one refinement of the invention, it is proposed that the internal combustion engine valve drive arrangement has at least two gate elements, each of which forms a portion of the at least one track segment. As the result of distributing the track segment over two gate elements, the switching segment may be situated completely on one of the gate elements, while the track segment connected upstream or downstream from the switching segment may be provided with a sufficient angular extent. A "gate element" is understood in particular to mean an element which at least partially forms the gate track. In principle, the gate element may be designed in one piece with the cam element.

The partial area of the track segment, which has only the radial inclination, is preferably situated, at least for the most part, on one of the gate elements. The partial area in which the track segment and the switching segment are designed in one piece may thus advantageously be situated on the second gate element, so that the switching segment may advantageously be provided for switching the second gate element. The term "for the most part" is understood in particular to mean that at least 50 percent, advantageously at least 60 percent, and particularly advantageously at least 75 percent, of the partial area which has only the radial inclination is situated on the first gate element.

In addition, it is advantageous for the switching segment to be situated completely on one of the gate elements. The second gate element may thus advantageously be displaced by means of the switching segment, so that switching capability of a cam element which is associated with the second gate element may advantageously be achieved. In this context, "completely" is understood in particular to mean that the switching segment which is situated on the second gate element is delimited by two partial areas which are situated on the second gate element and which extend in the peripheral direction. One of the partial areas is preferably formed by the track segment, and the second partial area is preferably formed by a transition segment. A "transition segment" is understood in particular to mean a partial area of the gate track which has neither an axial inclination nor a radial inclination. In one advantageous embodiment, all switching segments in each case are completely situated on one of the gate elements.

In addition, it is proposed that the internal combustion engine valve train device has at least one further track segment which has an axial inclination in at least one partial area. Switching capability of at least one further cam element may thus be achieved, so that an internal combustion engine valve train device may be implemented for an internal combustion engine having four or more cylinders.

At least one of the track segments preferably forms a meshing segment, and at least one of the track segments preferably forms a demeshing segment. An advantageous design of the gate track, in particular having a short length, may thus be achieved.

The internal combustion engine valve train device particularly advantageously includes a further switching segment which is designed, at least in part, in one piece with the further track segment. Thus, the meshing segment may be designed in one piece with the one switching segment, and the demeshing segment may be designed in one piece with the further switching segment, so that the length of the gate track may have a particularly advantageous design.

The invention will become more readily apparent from the following description of an exemplary embodiment of the invention with reference to the accompanying drawings. The drawings, the description, and the claims contain numerous features in combination. Those skilled in the art will also advantageously consider the features individually and combine them into further meaningful combinations.

DESCRIPTION OF EXEMPLARY EMBODIMENTS

Figure 1:
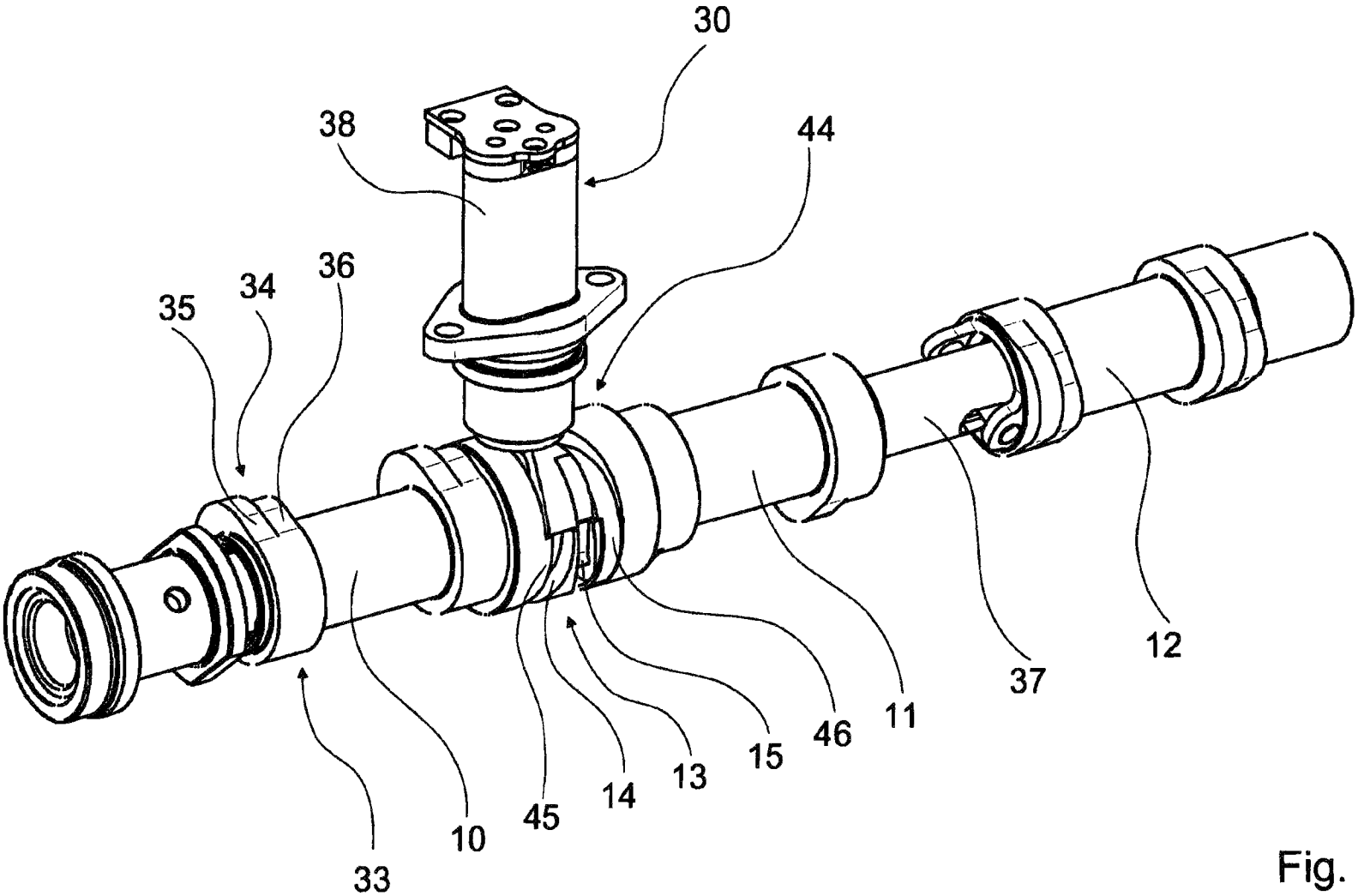
FIG. 1 shows an internal combustion engine valve train device according to the invention in a perspective top view.

FIGS. 1 through 14 show an internal combustion engine valve drive arrangement according to the invention. The internal combustion engine valve drive arrangement is provided for an internal combustion engine having at least three cylinders arranged in a row which have different valve activation times. The internal combustion engine valve drive arrangement may be used for an internal combustion engine in which only three cylinders are arranged in a row, such as for an in-line engine having three cylinders or a V engine having six cylinders, for example. However, the internal combustion engine valve drive arrangement is also usable for an internal combustion engine in which six cylinders are arranged in a row, each having the same or at least similar valve activation times.

The internal combustion engine valve drive arrangement includes a camshaft 33 having three cam elements 10, 11, 12. The cam elements 10, 11, 12 are in the form of cam supports. At least one cam 34, having two partial cams 35, 36 with different valve activation curves, is situated on each of the cam elements 10, 11, 12. The partial cams 35, 36 of each of the cams 34 are each situated directly adjacent to one another. The cam elements 10, 11, 12 are axially displaceable. A switch is made inside the cam 34 from one partial cam 35 to the other partial cam 36 by means of an axial displacement of one of the cam elements 10, 11, 12. Thus, each of the cam elements 10, 11, 12 has two discrete switching positions in which a different valve lift is switched for the cylinder(s) associated with the corresponding cam element 10, 11, 12.

The camshaft 33 has a drive shaft 37 for mounting of the cam elements 10, 11, 12. The drive shaft 37 includes a crankshaft connection for connection to a crankshaft, not illustrated in greater detail. The crankshaft connection may be provided via a camshaft adjuster which is provided for setting a phase position between the camshaft 33 and the crankshaft.

The cam elements 10, 11, 12 are axially displaceable on the drive shaft 37 in a rotationally fixed manner. The drive shaft 37 has spur toothing on its outer periphery. The cam elements 10, 11, 12 have corresponding spur toothing on their inner periphery which engages with the spur toothing of the drive shaft 37.

In addition, the internal combustion engine valve train device includes a switch gate 13. The switch gate 13 is provided for sequentially displacing the three cam elements 10, 11, 12 one after the other in a switching operation. The switch gate 13 includes two gate tracks 14, 15 for displacing the cam elements 10, 11, 12. The first gate track 14 is provided for displacing the cam elements 10, 11, 12 along a first switching direction from the first switching position into the second switching position (see FIGS. 5 through 9). The second gate track 15 is provided for displacing the cam elements 10, 11, 12 along a second switching direction from the second switching position into the first switching position (see FIGS. 10 through 14).

Furthermore, the internal combustion engine valve drive arrangement includes a switching unit 30 which has switch pins 31, 32 for engaging with the gate tracks 14, 15, respectively. The switching unit 30 has a stator housing 38 which is fixedly connected to an engine block, not illustrated in greater detail, of the internal combustion engine. The switch pins 31, 32 are situated in the stator housing 38 so as to be displaceable along their main direction of extension. The gate tracks 14, 15 are in the form of grooves in which the switch pins 31, 32, respectively, may be forcibly guided on both sides. During a switching operation in the first switching direction, the first switch pin 31 is brought into engagement with the first gate track 14. During a switching operation in the second switching direction, the second switch pin 32 is brought into engagement with the second gate track 15.

The gate tracks 14, 15 have a plurality of switching segments 20, 21, 22, 23, 24, 25. The first gate track 14 includes the three switching segments 20, 21, 22, which are provided for switching the three cam elements 10, 11, 12 in the first switching direction. The switching segments 20, 21, 22 are each associated with exactly one of the cam elements 10, 11, 12. The gate track 14 also includes a track segment 16 forming a meshing segment and a track segment 18 forming a demeshing segment. The second gate track 15 has an analogous design. The second gate track 15 includes the three switching segments 23, 24, 25, a track segment 17 designed as a meshing segment, and a track segment 19 forming a demeshing segment.

The switching segments 20, 21 22, 23, 24, 25 each have an axial inclination. Due to the axial inclination, the cam element 10, 11, 12 which is associated with the corresponding switching segment 20, 21, 22, 23, 24, 25 is displaced when the corresponding switch pin 31, 32 is engaged with the corresponding switching segment 20, 21, 22, 23, 24, 25. The track segments 16, 17 have a radial inclination. The gate tracks 14, 15, which are designed as grooves, have a continuously increasing depth in a partial area of the track segments 16, 17 forming meshing segments. The corresponding gate track 14, 15 has an essentially constant depth in an area situated between the track segment 16, 17 and the corresponding track segment 18, 19 forming a demeshing segment. The corresponding gate track 14, 15 has a continuously decreasing depth in the area of the track segments 18, 19.

Each of the two gate tracks 14, 15 is continuous; i.e., the switch pin 31, 32 brought into engagement with the gate track 14, 15, respectively, via the corresponding track segment 18, 19 runs in succession through the switching segments 20, 21, 22, 23, 24, 25 of the corresponding gate track 14, 15 before the switch pin 31, 32 is again released from the gate track 14, 15 by means of the track segment 18, 19. The cam elements 10, 11, 12 are thus sequentially switched one after the other. In a switching operation along the first switching direction, first the axially outer cam element, 10, then the axially middle cam element 11, and lastly the axially outer cam element 12 is switched. In a switching operation along the second switching direction, first the axially middle cam element 11 then the axially outer cam element 12, and lastly the axially outer cam element 10 is displaced. Thus, the two switching operations are not symmetrical with respect to a switching sequence of the cam elements 10, 11, 12.

For forming the two gate tracks 14, 15, the internal combustion engine valve drive arrangement includes three gate elements 26, 27, 28. The first gate element 26 is designed in one piece with the first cam element 10. The second gate element 27 and the second cam element 11 are likewise designed in one piece. The third gate element 28 is situated at a distance from the third cam element 12, and is connected to the third cam element 12 in a rotationally fixed as well as an axially fixed manner.

The switch gate 13 is situated in an area of the camshaft 33 in which the axially outer cam element 10 and the axially middle cam element 11 adjoin one another. In this area the two gate elements 26, 27 have only an angular range of 120 degrees camshaft angle in each case. The third gate element 28 is likewise situated in the area of the camshaft 33 in which the cam elements 10, 11 adjoin one another. The gate element 28 likewise has an angular range of 120 degrees camshaft angle. In the area of the switch gate 13, the three gate elements 26, 27, 28 thus have approximately equal angular ranges. Thus, in a rotation of the camshaft 33 by 360 degrees camshaft angle, the first gate element 26, the second gate element 27, and the third gate element 28 face the switching unit 30 in succession, The three gate elements 26, 27, 28 form the gate tracks 14, 15. The gate tracks 14, 15, which are grooves, are cut directly into the gate elements 26, 27. 28. The three gate elements 26, 27, 28 in each case form a portion of the gate track 14, 15.

The track segment 16 of the gate track 14 which is a meshing segment starts on the third gate element 28 and ends on the first gate element 26. The first switching segment 20 of the gate track 14 is situated completely on the first gate element 26. The second switching segment 21 of the gate track 14 is situated completely on the second gate element 27. The third switching segment 22 of the gate track 14 is situated completely on the third gate element 28. The track segment 18 of the gate track 14 which is a demeshing segment extends from the third gate element 28 to the first gate element 26. The gate track 14 thus extends over an angle that is larger than 360 degrees camshaft angle.

The track segment 17 of the gate track 15 starts on the first gate element 26 and ends at the second gate element 27. The first switching segment 23 of the gate track 15 is situated on the second gate element 27. The second switching segment 24 of the gate track 15 is situated on the third gate element 28. The third switching segment 25 of the gate track 15 is situated on the first gate element 26. The track segment 19 of the gate track 15 extends from the third gate element 28 to the first gate element 26. The gate track 15 thus likewise extends over an angle that is larger than 360 degrees camshaft angle.

Figure 2:
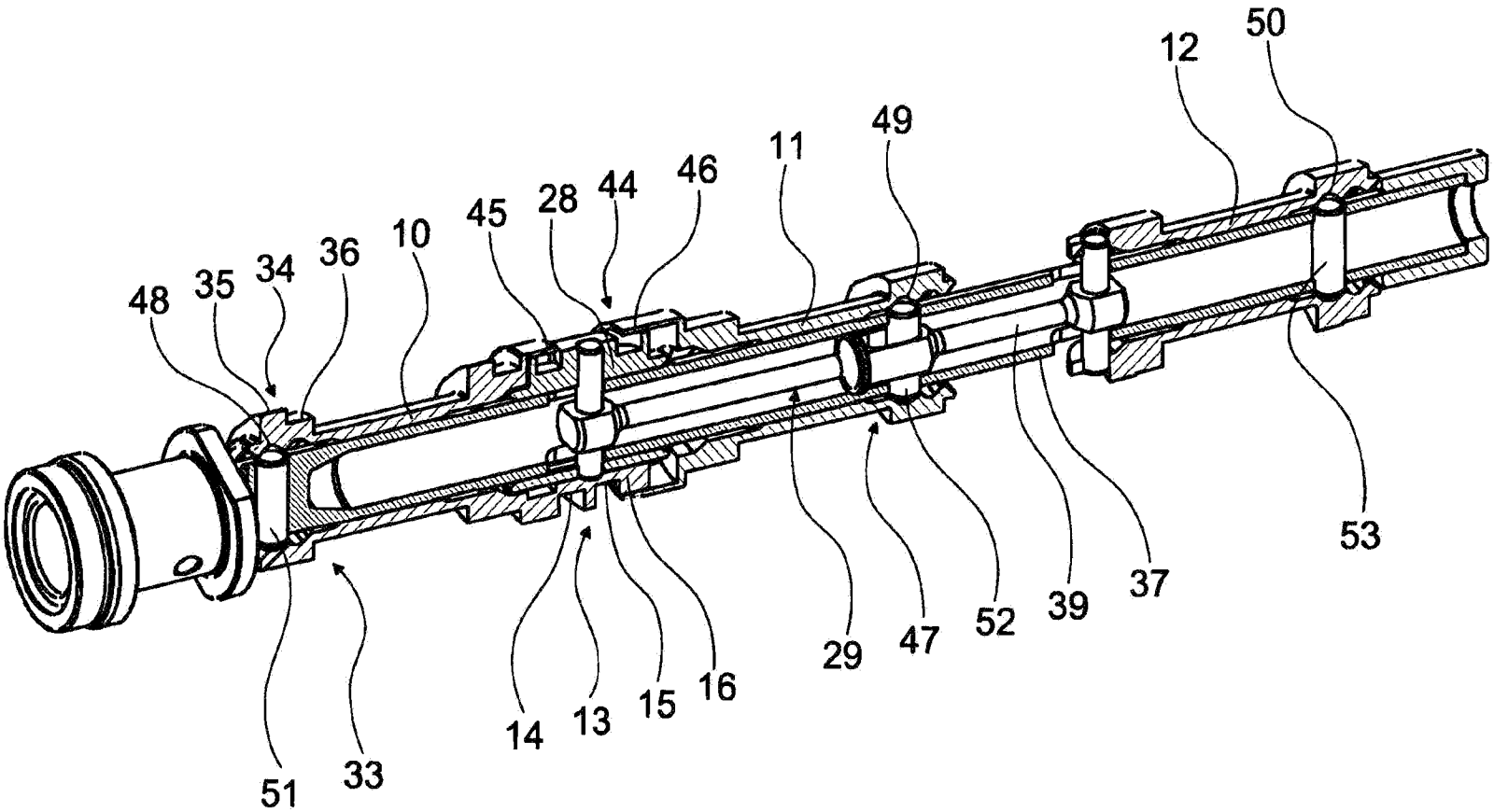
FIG. 2 shows the internal combustion engine valve train device in a partial longitudinal section.

The third gate element 28 and the axially outer cam element 12 are coupled to one another for axial movement (see FIG. 2). The drive shaft 37 is designed, at least in part, as a hollow shaft. The internal combustion engine valve drive arrangement includes a connecting unit 29 which couples the third gate element 28 to the third cam element 12. The connecting unit 29 includes a coupling rod 39 which is guided in the drive shaft 37. The drive shaft 37 includes a first opening through which the coupling rod 39 is coupled to the gate element 28, and a second opening through which the coupling rod 39 is coupled to the cam element 12. The cam element 12 is thus coupled to an axial motion of the gate element 28 in an at least practically rigid manner. The cam element 12 and the gate element 28 are connected to one another in a rotationally fixed manner via the drive shaft 37.

The first gate track 14 is provided for an adjustment of the cam elements 10, 11, 12 in the first switching direction. The second gate track 15 is situated in a mirror image with respect to the first gate track 14 and phase-shifted relative to same. Thus, the structure of the second gate track 15 corresponds to that of the first gate track 14. A difference between the two gate tracks 14, 15 is that the axial inclination of the switching segments 23, 24, 25 of the second gate track 15 is directed oppositely with respect to the axial inclination of the switching segments 20, 21, 22 of the first gate track 14. In addition, a start of the second gate track 15 is phase-shifted with respect to a start of the first gate track 14. Thus, due to the structural similarities, in particular the first gate track 14 is described below; a description of the first gate track 14, taking into account the phase offset, in principle is analogously applicable to the second gate track 15.

The track segment 16 of the gate track 14 designed as a meshing segment, the switching segments, and the first switching segment 20 are partially designed in one piece. The gate track 14 has an axial inclination and a radial inclination in a partial area in which the track segment 16 and the switching segment 20 are designed in one piece. In addition, the track segment 18 designed as a demeshing segment and the switching segment 22 are partially designed in one piece. The gate track 14 likewise has an axial inclination and a radial inclination in a partial area in which the track segment 18 and the switching segment 22 are designed in one piece.

The track segment 16 designed as a meshing segment, the switching segments 20, 22, and the track segment 18 designed as a demeshing segment are also partially separate. Originating from a start, the gate track 14 includes a partial area which has solely a radial inclination. In this partial area, in which the gate track 14 extends in the peripheral direction and has only an increasing radial depth, the track segment 16 is separate from the switching segment 20. The partial area in which the track segment 16 and the switching segment 20 are separate is situated for the most part on the gate element 28.

The partial area in which the switching segment 20 and the track segment 16 are designed in one piece adjoins the partial area which has solely the radial inclination. The switching segment 16, and thus also the partial area in which the track segment 16 and the switching segment 20 are designed in one piece, is situated completely on the cam so element 10.

A partial area of the gate track 14 in which the gate track 14 has solely an axial inclination adjoins this partial area. The switching segment 20 and the track segment 16 are once again separate in this partial area. The gate track 14 has an approximately constant depth in this partial area. The switching segment 20 is followed by a transition segment 40 in which the gate track 14 has neither a radial inclination nor an axial inclination. The transition segment 40 provides a transition from the cam element 10 to the cam element 11. The transition segment 40 is formed partly by the cam element 10. The transition segment 40 is situated between the two switching segments 20, 21.

The portion of the gate track 14 that is situated on the gate element 27 has an essentially constant depth. The gate element 27 forms a further portion of the transition segment 40. In addition, the switching segment 21 is situated completely on the cam element 11.

For a transition between the switching segment 21 and the switching segment 22, the gate track 14 includes a further transition segment 41 which has neither a radial inclination nor an axial inclination. The further transition segment 41 adjoins the switching segment 21. The transition segment 41 is formed partly by the cam element 11 and partly by the gate element 28.

The switching segment 22 associated with the cam element 12 adjoins the transition segment 41. The gate track 14 initially has solely an axial inclination in a partial area which directly adjoins the transition segment 41. The switching segment 22 is initially separate from the track segment 18 which is a demeshing segment.

In its further progression, the gate track 14 once again has a partial area with an axial inclination and a radial inclination. The track segment 18 and the switching segment 22 are designed in one piece in this partial area. In the partial area in which the track segment 18 and the switching segment 22 are designed in one piece, the gate track 14 has a decreasing depth. This partial area is adjoined by a partial area in which the track segment 18 is separate from the switching segment 22. In this latter partial area, the gate track 14 has solely a radial inclination. A majority of the partial area in which the track segment 18 is separate from the switching segment 22 is formed by the first gate element 26.

The switch pins 31, 32 of the switching unit 30 are respectively provided for one of the two switching directions in which the cam elements 10, 11, 12 may be displaced. The switch pin 31 provided for the first switching direction is extended in order to displace the cam elements 10, 11, 12 in the first direction. The switch pin 31 is brought into engagement with the track segment 16 of the first gate track 14 in the form of a meshing segment due to the rotary motion of the camshaft 33 (see FIG. 5). Upon further rotary motion of the camshaft 33, the switch pin 31 initially partially meshes with the gate track 14 without an axial force being exerted on one of the cam elements 10, 11, 12.

Figure 6:
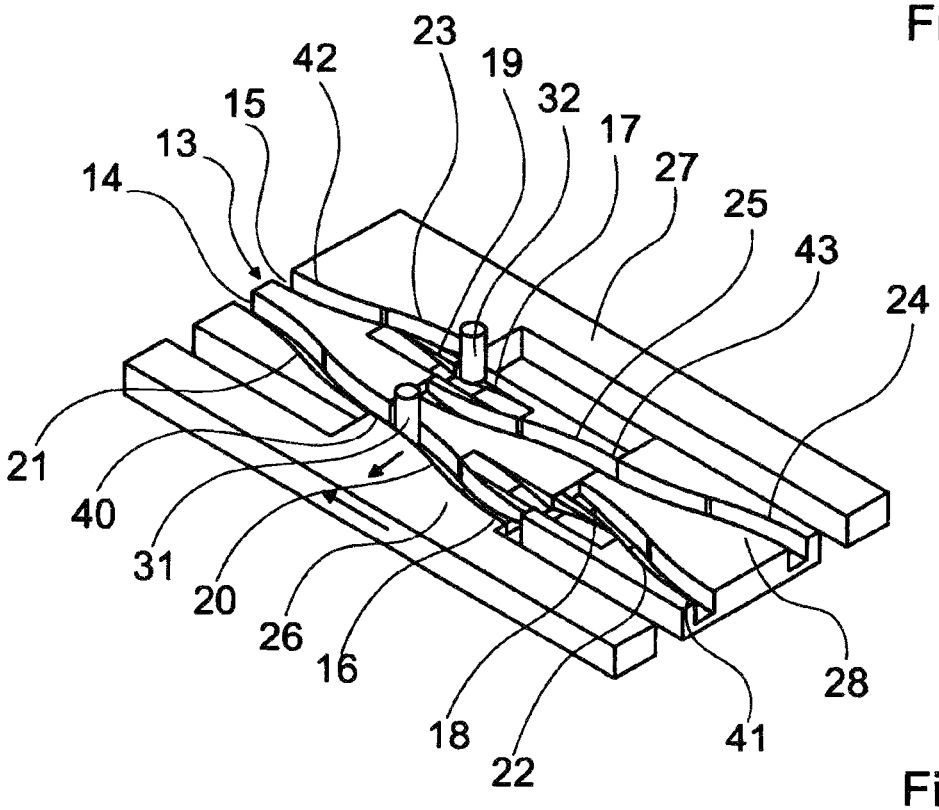

The switch pin 31 engages with the switching segment 20, which is situated on the first gate element 26 and associated with the first cam element 10, due to the further rotary motion of the camshaft 33 (see FIG. 6). As a result of one-piece design of the switching segment 20 and the track segment 16 designed as a meshing segment, the switch pin 31 is also engaged with the track segment 16. The rotary motion of the camshaft 33 thus brings about an axial force on the cam element 10, while the switch pin 31 engages further with the gate track 14. The cam element 10 is displaced from the first switching position into the second switching position due to the engagement of the switch pin 31 with the switching segment 20 and the rotary motion of the camshaft 33.

After the switch pin 31 has completely passed through the switching segment 20, the cam element 10 is switched into the second switching position. The switch pin 31 engages with the first transition segment 40 due to the further rotary motion. As a result of the rotary motion of the camshaft 33, the switch pin 31 is transferred from the portion of the gate track 14 that is situated on the first gate element 26 to the portion of the gate track 14 that is situated on the second gate element 27.

Figure 7:
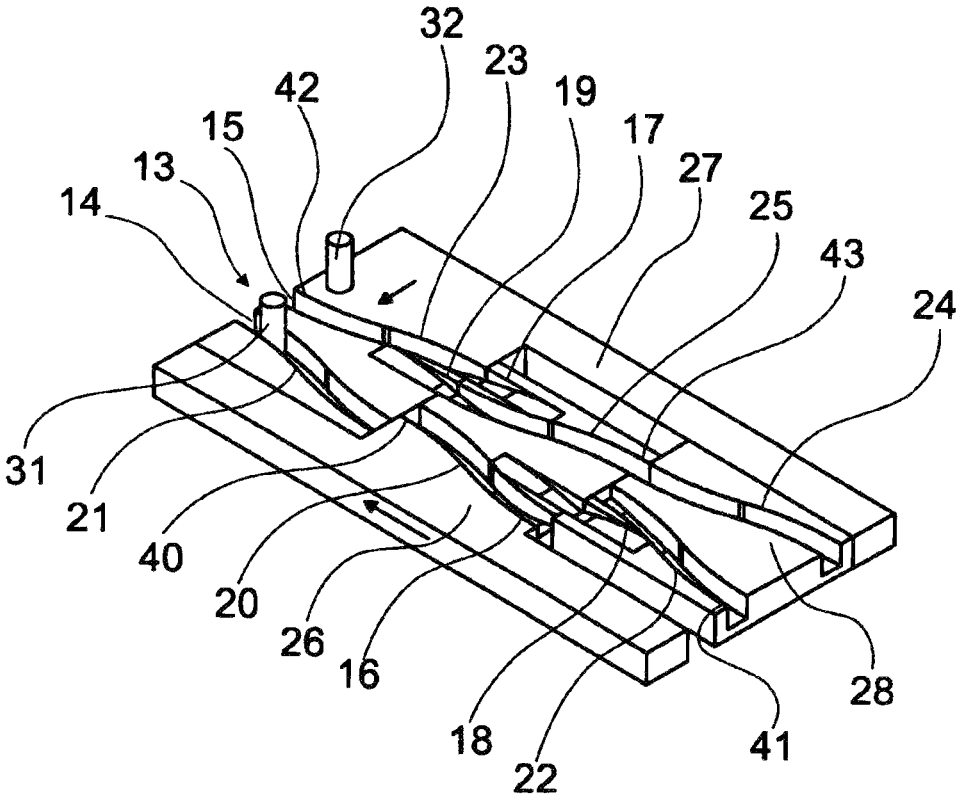
Figure 8:
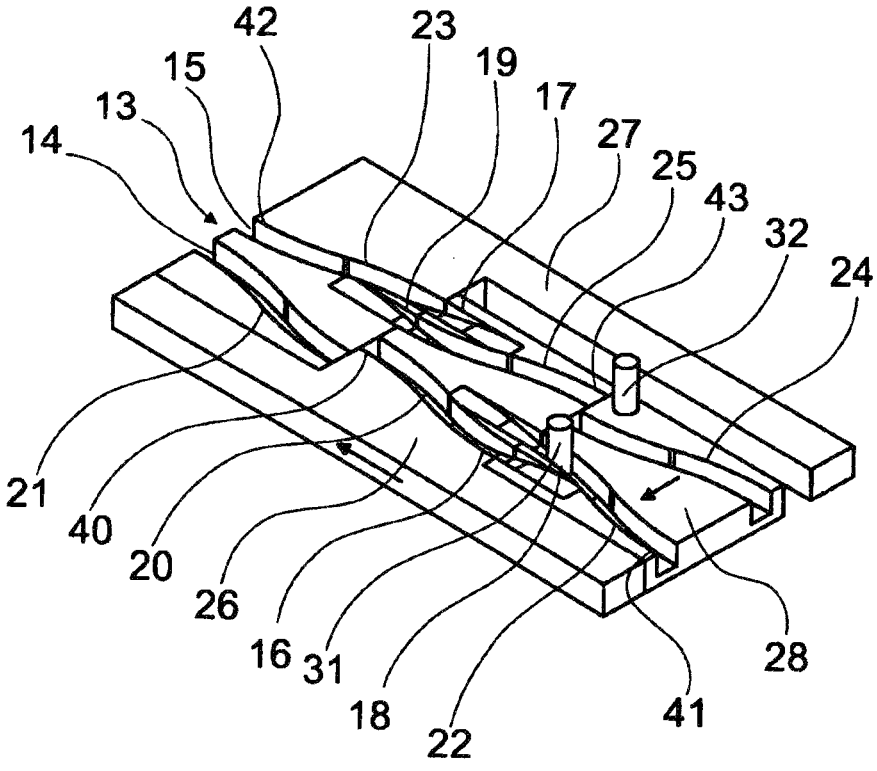
Figure 9:
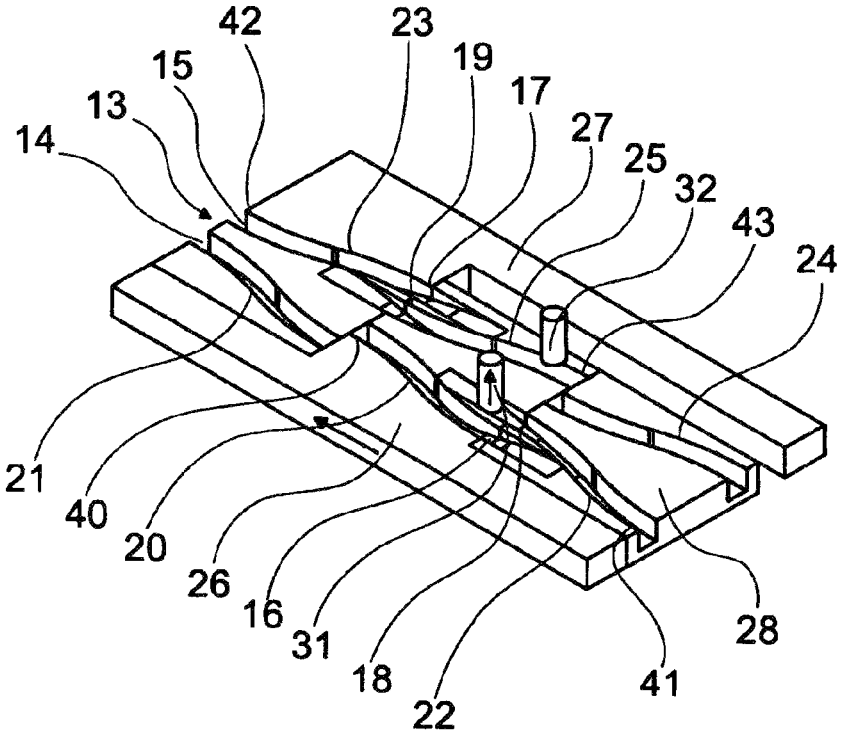
Figure 10:
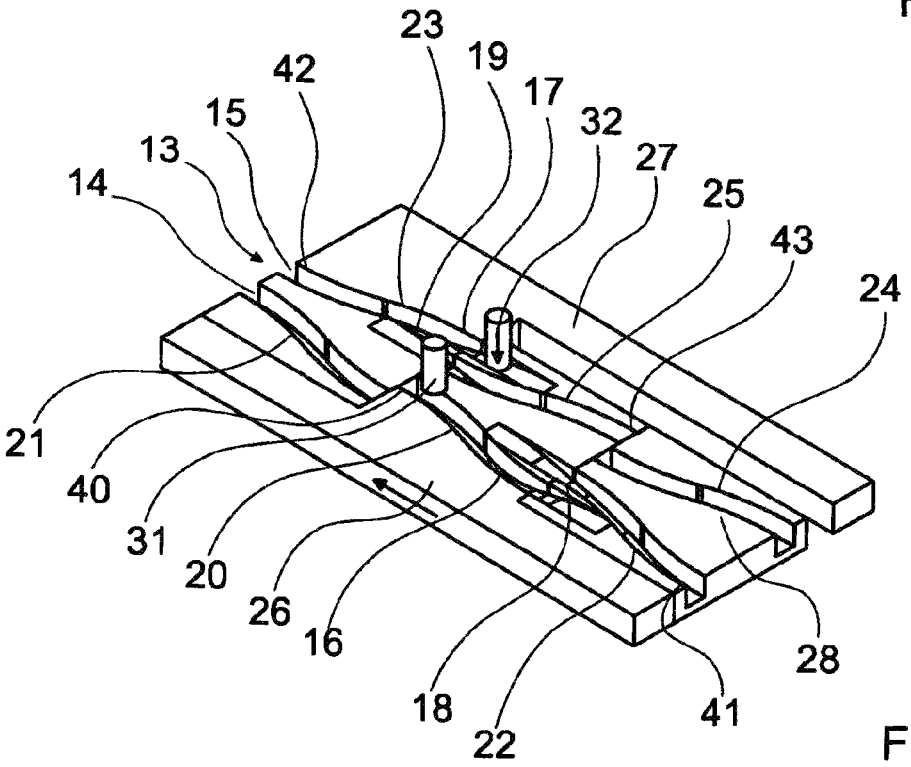
FIGS. 10-14 show a switching operation along a second switching direction.
Figure 11:
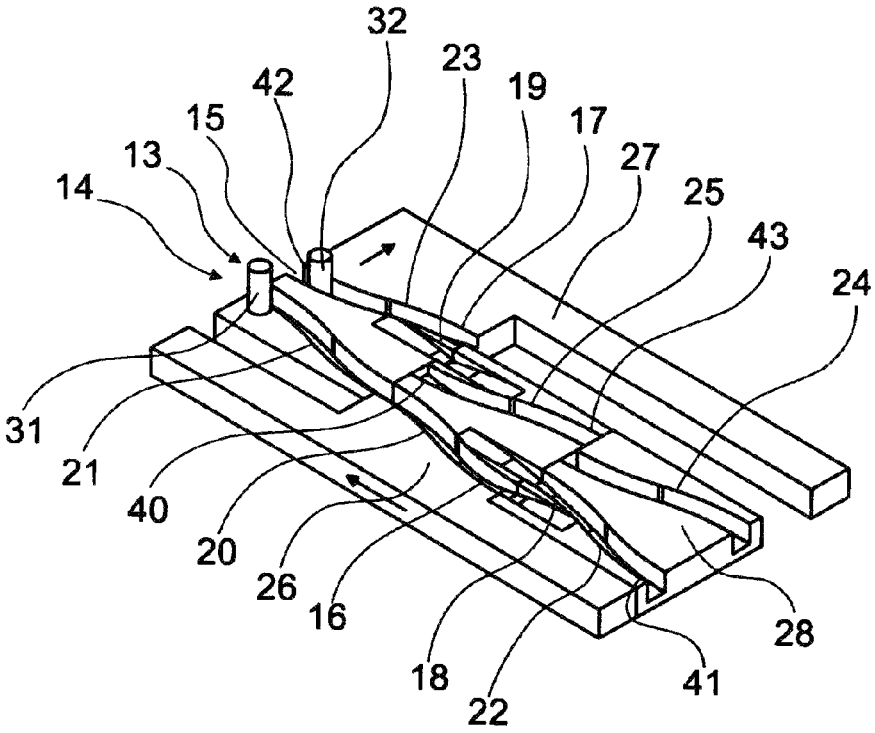
Figure 12:
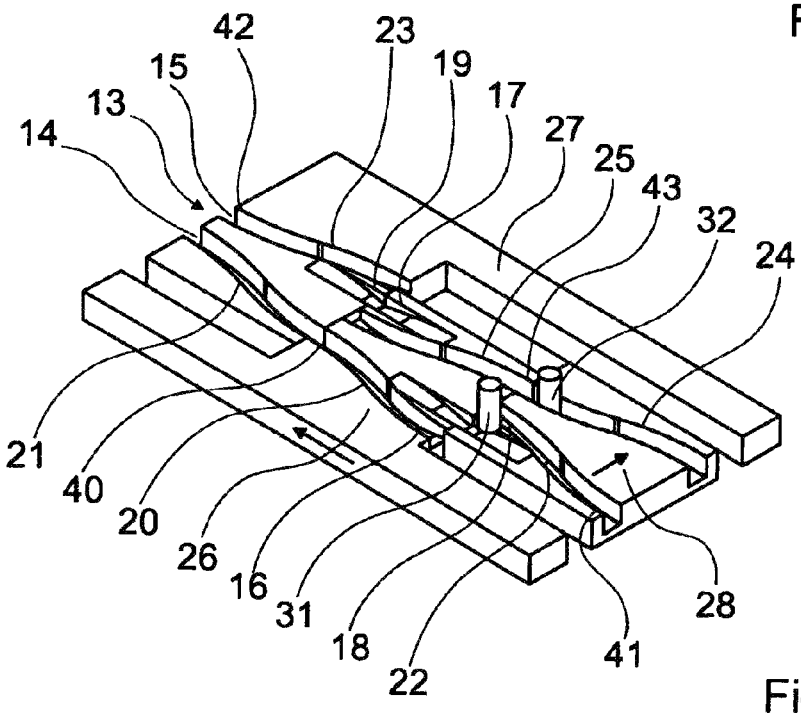
Figure 13:
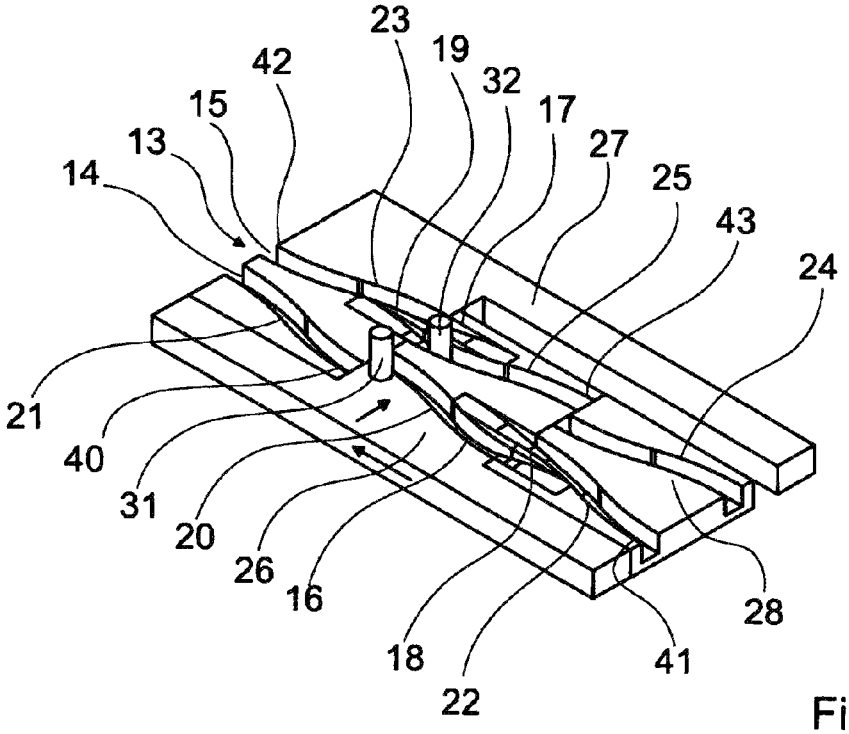
Figure 14:
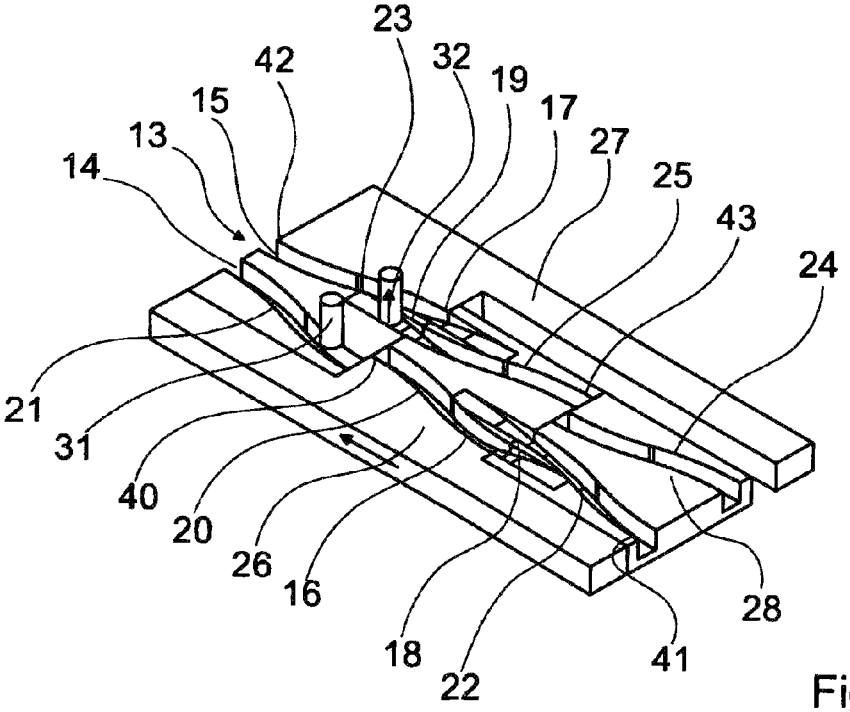

Due to the further rotary motion, the switch pin 31 becomes engaged with the switching segment 21 which is situated on the second gate element 27 and associated with the second cam element 11 (see FIG. 7). The rotary motion of the camshaft 33 and the engagement of the switch pin 31 with the switching segment 21 bring about an axial force on the cam element 11 which switches the cam element 11 from the first switching position into the second switching position. After the switch pin 31 has completely passed through the switching segment 21, the cam element 11 is switched into the second switching position.

Upon further rotary motion of the camshaft 33, the switch pin 31 is transferred via the transition segment 41 from the second gate element 27 to the third gate element 28. The switch pin 31 thus becomes engaged with the switching segment 22 which is situated on the gate element 28 and is associated with the cam element 12.

Since the switching segment 22 is partly separate from the track segment 18 designed as a demeshing segment, the rotary motion of the camshaft 33 and the engagement of the switch pin 31 with the gate track 14 initially bring about only an axial force on the cam element 12. Due to the further rotary motion, the switch pin 31 reaches the partial area in which the switching segment 22 and the track segment 18 are designed in one piece (see FIG. 8). The switch pin 31 is thus already demeshed, while a force still acts on the cam element 12 which displaces the cam element 12 along the first switching direction.

As soon as the switch pin 31 has passed through the switching segment 22, the cam element 12 is also switched into the second switching position. The switch pin 31 is further demeshed due to the track segment 18 designed [as a demeshing segment], which is also separate from the switching segment 22 (see FIG. 9). During the demeshing, the switch pin 31 is pushed into the stator housing 38 due to the rotary motion of the camshaft 33 and the radial inclination of the gate track 14. As soon as the switch pin 31 has completely passed through the track segment 18 which is a demeshing segment, the switching operation of the cam elements 10, 11, 12 from the first switching position into the second switching position is fully complete.

A switching operation in the second switching direction by means of the second gate track 15 is carried out in an analogous manner. After the meshing into the track segment 17 of the gate track 15 (see FIG. 10), the switch pin 32 passes through the track segment 17 and the switching segment 23 (see FIG. 11). The switch pin 32 is then transferred to the subsequent switching segment 24 by means of a transition segment 42 (see FIG. 12). The switch pin 32 is transferred to the switching segment 25 by means of a transition segment 43 (see FIG. 13), and is subsequently again demeshed by means of the track segment 19 (see FIG. 14).

The track segments 16, 17 designed as meshing segments each have an angular range of approximately 110 degrees camshaft angle. The switching segments 20, 21, 22, 23, 24, 25 each have an angular range of likewise approximately 110 degrees camshaft angle. The transition segments 40, 41, 42, 43 each have an angular range of approximately 10 degrees camshaft angle. The track segments 18, 19 designed as demeshing segments each have an angular range of approximately 95 degrees camshaft angle.

The track segment 16 and the first switching segment 20 of the first gate track 14 are designed in one piece over an angular range of approximately 40 degrees camshaft angle. The last switching segment 22 of the first gate track 14 and the track segment 18 are likewise designed in one piece over an angular range of approximately 40 degrees camshaft angle. The second gate track 15 has an analogous design. The gate tracks 14, 15 thus each have a length of approximately 475 degrees camshaft angle. Thus, the track segments 16, 17 designed as meshing segments and the track segments 18, 19 of the gate tracks 14, 15, respectively, designed as demeshing segments are each partly axially situated next to one another.

Figure 3:
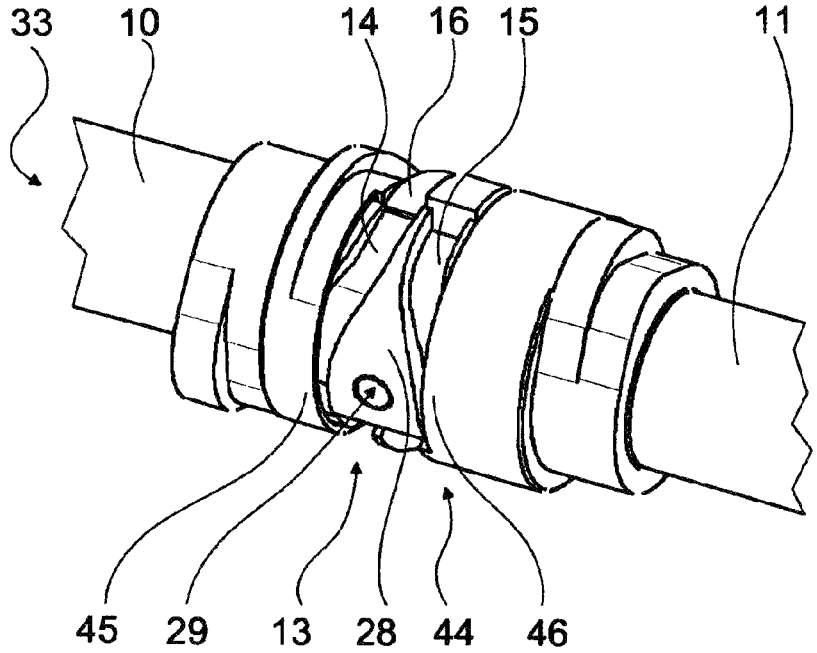
FIG. 3 shows a switch gate of the internal combustion engine valve train device.
Figure 4:
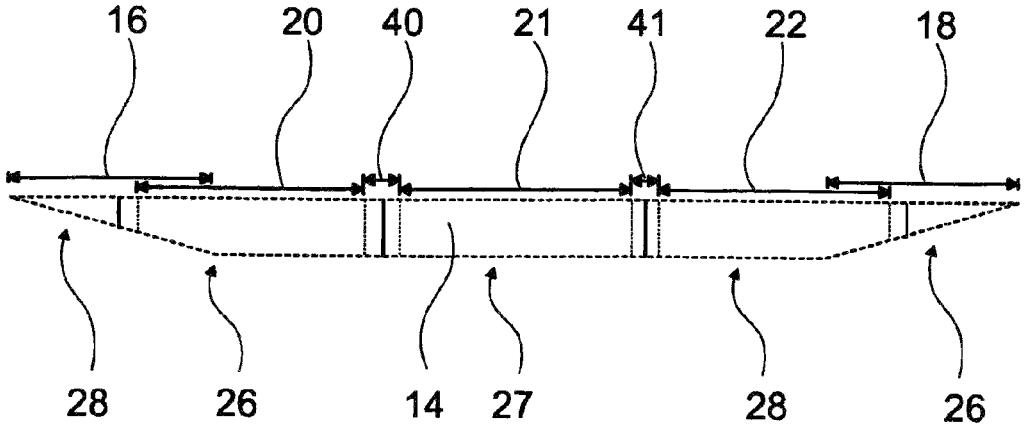
FIG. 4 shows a gate track of the switch gate in a schematic illustration.
Figure 5:
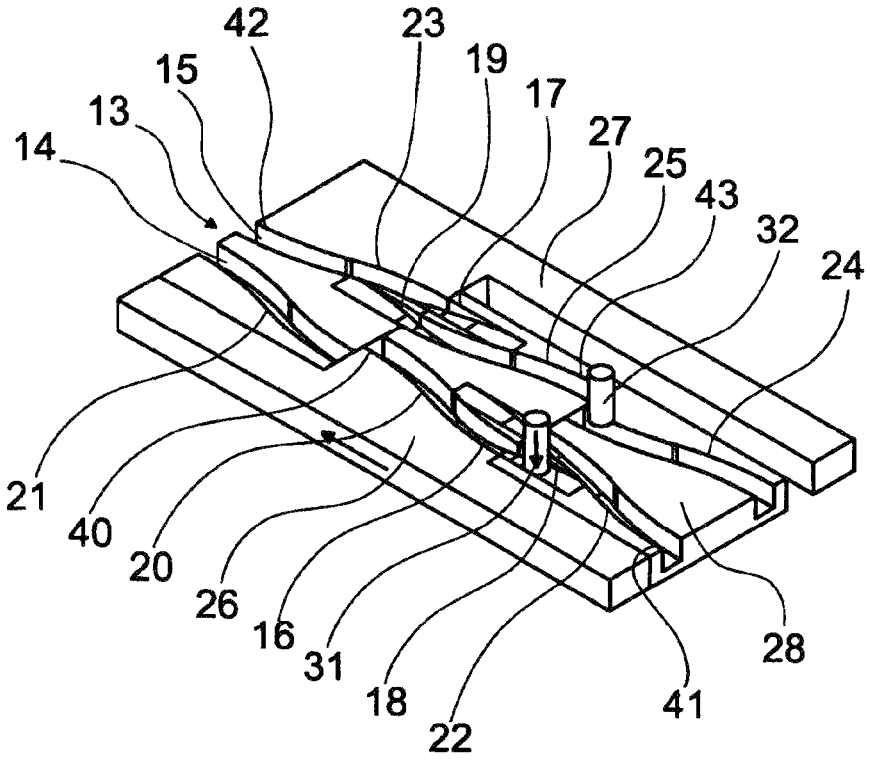
FIGS. 5-9 show a switching operation along a first switching direction.

To prevent improper meshing of the switch pins 31, 32 directly into one of the switching segments 20, 21, 22, 23, 24, 25 while skipping the corresponding meshing track segment 16, 17, the internal combustion engine valve train unit has a cover unit 44 (see FIG. 3). The cover unit 44 is provided for covering unused parts of the gate tracks 14, 15.

For partially covering the first gate track 14, the cover unit 44 includes a first cover element 45 which is fixedly connected to the first gate element 26, which forms the meshing track segment 16. The switching segment 21 of the second cam element 11 and the switching segment 22 of the third gate element 28 are covered by the cover element 45 in an operating state in which the cam elements 10, 11, 12 are in one of the switching positions. The meshing track segment 16 and the switching segment 20 of the first gate element 26 are open. The cover element 45, which is coupled to the first gate element 26, releases the switching segment 21 of the second gate element 27 and the switching segment 22 of the third gate element 28 due to the displacement of the first cam element 10 by means of the first switching segment 20. The switch pin 31 may thus mesh with the gate track 14 solely via the portion of the gate track 14, situated on the first gate element 26, into the switching segments 21, 22 of the gate track 14 situated on the second gate element 27 and the third gate element 28.

The cover unit 44 includes a second cover element 46 for partially covering the second gate track 15. The second cover element 46 has a design that is analogous to the first cover element 45. Both cover elements 45, 46 are designed in the form of a sleeve, which in the appropriate switching position encloses parts of the switch gate 13, and thus partially covers the gate tracks 14, 15. The cover elements 45, 46 have an angular range of approximately 240 degrees camshaft angle. The segments 16, 17 designed as meshing segments are partially introduced into the cover elements 45, 46.

The switching unit 30 has a bistable design. The two switch pins 31, 32 may remain in an unactivated state in an extended switching position and also in a retracted switching position. The switch pins 31, 32 have an unstable middle position. If one of the switch pins 31, 32 is in a position between the extended switching position and the middle position, the corresponding switch pin 31, 32 automatically switches into the extended switching position. If one of the switch pins 31, 32 is in a position between the retracted switching position and the middle position, the corresponding switch pin 31, 32 automatically switches into the retracted switching position.

For extending the switch pins 31, 32, the switching unit 30 includes an electrical actuator unit by means of which a force for the extension may be exerted on the switch pins 31, 32. The switch pins 31, 32 are independently extendable. The actuator unit is provided solely for extending the switch pins 31, 32. The switch gate 13 is provided for retracting the switch pins 31, 32. During the demeshing of the switch pins 31, 32 from the corresponding gate track 14, 15, respectively, the switch pins 31, 32 are moved over the unstable middle position and automatically retract. Thus, the track segments 18, 19 of the gate tracks 14, 15 designed as demeshing segments are provided for retracting the switch pins 31, 32.

The internal combustion engine valve train device has a locking unit 47 for locking the cam elements 10, 11, 12 in the switching positions. The cam elements 10, 11, 12 in each case have two locking positions. The locking unit 47 includes a plurality of locking recesses 48, 49, 50 which are provided at the inner sides of the cam elements 10, 11, 12. In addition, the locking unit 47 includes a plurality of thrust pieces 51, 52, 53 which are fixedly connected to the drive shaft 37. The cam elements 10, 11, 12 are locked with respect to the drive shaft 37 by means of the thrust pieces 51, 52, 53.

A sequence in which the switch pins 31, 32 come into engagement with the cam elements 10, 11 and the gate element 28 while passing through the corresponding gate track 14, 15 may have any given design in principle. For example, it is conceivable for the gate element 28 to have a track segment designed as a meshing segment, the gate element 27 subsequently being situated on the gate element 28, and the gate element 26 having a track segment designed as a demeshing segment. A sequence in which the cam elements 10, 11, 12 are thus displaced is freely definable in principle.

What is claimed is:

1. An internal combustion engine valve drive arrangement having three axially displaceable cam elements (10, 11, 12) with a switch gate (13), coupled to the cam elements (10, 11, 12), the switch gate (13) including gate tracks (14, 15) with track segments (16, 17, 18, 19) and switching segments (20, 21, 22, 23, 24, 25), formed in three different gate elements (26, 27, 28) and being disposed between two cam elements (10, 11) for displacing the cam elements (10, 11, 12) with the two gate elements (26, 27) disposed adjacent the cam elements (10, 11) being formed integrally with the respective adjacent elements (10, 11), the track segments (16, 17, 18, 19) and the switching segments (20, 22, 23, 25) being formed to extend continuously over the gate elements (26, 27, 28) so that, in a partial area, the guide tracks (14, 15) have a double function providing for an insertion or a removal of a switch pin (31, 32) and for a switching of the displaceable cam elements (10, 11, 12).

2. The internal combustion engine valve drive arrangement according to claim 1, wherein the track segments (16, 17, 18, 19) include partial areas which have only a radial inclination.

3. The internal combustion engine valve drive arrangement according to claim 1, wherein the switching segment areas (20, 22, 23, 25) include partial areas which have only an axial inclination.

4. The internal combustion engine valve drive arrangement according to claim 1, wherein the gate tracks (14, 15) have axial inclinations and radial inclinations in the at least one partial area in which the track segment (16, 17, 18, 19) and the switching segment (20, 22, 23, 25) are designed in one piece.

5. The internal combustion engine valve drive arrangement according to claim 2, wherein the partial area of each track segment (16, 17, 18, 19) which has only the radial inclination is situated, at least for the most part, on one of the gate elements (26, 27, 28).

6. The internal combustion engine valve drive arrangement according to claim 1, wherein the switching segment (20, 21, 22, 23, 24, 25) is situated completely on one of the gate elements (26, 27, 28).

7. The internal combustion engine valve drive arrangement according to claim 1, wherein at least one of the track segments (16, 18) forms a meshing segment, and at least one of the other track segments (17, 19) forms a demeshing segment.

* * * * *